US006155911A

United States Patent [19]

Mandler

[11] Patent Number: 6,155,911

[45] Date of Patent: Dec. 5, 2000

[54] METHOD AND DEVICE FOR POLISHING BOTH SIDES OF OPTICAL LENSES

[75] Inventor: Roland Mandler, Heuchelheim, Germany

[73] Assignee: OptoTech Optikmaschinen GmbH, Wettenberg, Germany

[21] Appl. No.: 09/190,478

[22] Filed: Nov. 12, 1998

[30] Foreign Application Priority Data

Nov. 14, 1997 [DE] Germany ..... 197 50 428

[51] Int. Cl.[7] ..... B24B 1/00

[52] U.S. Cl. ..... 451/42; 451/56; 451/58; 451/65; 451/72

[58] Field of Search ..... 451/36, 41, 42, 451/56, 57, 58, 60, 65, 72, 254, 256, 277

[56] References Cited

U.S. PATENT DOCUMENTS 4,598,502 7/1986 Lombard .
4,768,308 9/1988 Atkinson, III et al. .
5,024,024 6/1991 Watanabe .
5,482,495 1/1996 Mayahara et al. ..... 451/5
5,498,200 3/1996 Werner ..... 451/460
5,951,375 9/1999 Mandler ..... 451/42
5,951,376 9/1999 Mandler ..... 451/43

*Primary Examiner*—Timothy V. Eley
*Attorney, Agent, or Firm*—Friedrich Kueffner

[57] ABSTRACT

A process and a device for polishing both sides of an optical lens, in which the lens is mounted in a first workpiece holder and is polished on a first side and a second workpiece holder is then positioned opposite the first work piece holder. The lens, without being turned around, is transferred to the second workpiece holder, where its other side is polished by treatment coming from the side of the first workpiece holder.

7 Claims, 3 Drawing Sheets

METHOD AND DEVICE FOR POLISHING BOTH SIDES OF OPTICAL LENSES

BACKGROUND OF THE INVENTION

1. Field of the Invention

The present invention relates to a method or polishing both sides of an optical lens, in which the lens is mounted in a first workpiece holder and polished on a first side. The invention also relates to a device for polishing both sides of optical lenses.

2. Description of the Related Art

Optical lenses are produced out of transparent materials by several grinding processes or other material-removing machining methods. Mineral glass or suitable plastics can be used. In every case, at least one polishing process, by means of which the surface roughness of the lens is reduced to such an extent that the amount of light scattered at the surface becomes negligible, is carried out after the above-cited machining processes which give the lens its basic shape.

In the methods conventionally used today, the time required to polish the lenses is about twice as long as the time required for the preceding machining processes to shape the lens. It is therefore an especially important development goal to reduce the polishing time. Because the polishing time itself, i.e., the time during which the polishing tool is in actual contact with the lens, cannot be reduced in any immediate way because of the nature of the process, the idea of reducing the nonproductive times becomes especially significant.

According to the state of the art, lenses are polished by means of the following technology:

Polishing machines have a pivoting head at the top, which carries the tool spindle, to the lower end of which the polishing tool, usually a shaping tool, is attached. The pivoting head itself is able to pivot around the so-called "B axis" and is attached to an X slide, which can execute horizontal movements perpendicular to the B axis. In the lower part of the polishing machine there is a Z slide, which can move vertically and which carries the workpiece spindle, the axis of which is vertical. The axes of the tool spindle and the workpiece spindle are on a common plane, which is perpendicular to the B axis. Each of the two spindles has its own drive, which rotates them. Other distributions of the axes as well as an exchange of place between top and bottom are, of course, also possible.

So that the relative velocity between the shaping tool and the lens is as optimal as possible at every point on the surface of the lens, one of the two spindle axes must be set at an angle during polishing. In the polishing machines conventionally used today, this is accomplished by pivoting the above-cited, top-mounted pivoting head, to which the tool spindle is attached. The tool spindle is thus set at an angle. The diameter of the shaping tool is approximately twice that of the lens, which is laid against the tool in such a way that its edge does not project beyond the center of rotation of the shaping tool. For geometric reasons, the point of intersection of the two spindle axes must coincide with the center of curvature of the lens, which, after the pivoting head has been set at an angle, can be accomplished by moving the X slide and the Z slide.

The side of the shaping tool which rests against the lens during polishing is lined with a soft material. By adding a polishing suspension, which contains fine, solid particles, to this soft lining, material can removed from the lens in the desired way. Although essentially only the surface roughness is reduced during polishing, nevertheless a certain correction of the lens shape also occurs in the high-precision range. For this reason, the polishing tools must be made very precisely and must be reworked repeatedly as a result of the wear which occurs during polishing by means of a so-called "dressing" tool. In the past, the workpiece holder had to be removed from the workpiece spindle so that the dressing tool could be attached to this spindle. As a result of the natural tolerances of the participating components, tolerance errors developed with respect to the axial positions of the workpiece holder, dressing tool, and contour of the shaping tool when the components were changed. These tolerance errors in the axial position of the participating components led to loss of lens precision.

Dressing tools have recently become available which are combined with a workpiece holder; these are referred to below as "combination tools". A corresponding device is described in European patent application Serial No. 96-107, 870.6, published as EP 0 807 491 A1, corresponding to U.S. Pat. No. 5,951,375. When these combination tools are used, the above-cited tolerance problems are avoided, because it is no longer necessary to replace the workpiece holder with a dressing tool to dress the shaping tool.

Nevertheless, the polishing processes normally used today still suffer from a significant disadvantage (even when the combination tools are used), namely, that the lens to be processed must be removed from the workpiece holder after the first surface has been polished and turned around so that it can be laid in a second polishing machine with the proper shaping tool for the second lens surface. This process is time-consuming and also carries with it the danger of damage to the first, already finished, surface of the lens.

So that the first, already finished lens surface is not damaged by the workpiece holder while the second surface is being polished, it must be provided with a coating of protective lacquer. It is time-consuming the apply this lacquer, and it is also time-consuming to remove it afterwards. In addition, undesirable drying times and environmental problems are also associated with the use of solvent-containing lacquers. The application of lacquer coatings with a highly uniform thickness, furthermore, is desirable with respect to the precision of the lens, but it difficult if not impossible to achieve this in practice.

In the processes normally used today to polish lenses, a workpiece holder is used which consists essentially of a hollow cylinder of plastic, the inside diameter of which matches the size of the lens, so that the lens can be inserted into it. In its interior, the hollow cylinder usually has a rubber membrane. Pressure can be applied to this membrane to press it flat against the lens. As a result, the lens is pressed against the shaping tool. Because of the special properties and inaccuracies of the membrane, this applied pressure between the lens and the shaping tool suffers from small irregularities across the surface. This is a disadvantage of the known lens polishing devices, which again has an unfavorable effect on the precision of the lens.

Devices have also become known in which this membrane is eliminated. Instead of lying on a membrane, the lens rests by its edges on a small shoulder in the tool holder at first. When compressed air acts on the back surface of the lens, it lifts the lens from the collar and presses it against the shaping tool. Although the pressure distribution is now more uniform that it was when a membrane was used, other disadvantages are encountered. Because air is compressible, the force holding the lens against the shaping tool is not as stable as would be desired. In addition, the air which flows through the gap between the lens and the workpiece holder exerts a drying effect on the polishing suspension around the edges of the lens, which is highly disadvantageous because of the cleaning work it entails. It is also unfavorable that compressed air is unable to dissipate adequately the heat of friction which develops during polishing, which means that the lens heats up unevenly. This can lead to distortion as a result of thermal expansion and thus to inaccuracies.

SUMMARY OF THE INVENTION

It is, therefore, the primary object of the present invention to produce optical lenses more inexpensively and yet more precisely than in accordance with the state of the art.

In accordance with the present invention, this object is met by a method of the general type described above in that a second workpiece holder is positioned opposite the first work piece holder, and in that the lens, without being turned around, is transferred to the second workpiece holder, where its other side is polished by treatment coming from the side of the first workpiece holder.

In the method according to the invention and in the device (machine) for implementing the method, at least some of the disadvantages described above are avoided.

Both sides of the lens are therefore polished in a single machine. After the first polishing process, the lens can be transported from the first work piece holder to the second workpiece holder without being turned around. During this step, the alignment of the lens to the machine can be preserved with a high degree of accuracy. There is no need to change the tool, because a tool can be kept ready on one side of the lens for the first polishing process, whereas another tool can made available on the other side of the lens to polish the second side. Because both tools are present in the corresponding device, they can already be properly positioned there and then moved very precisely, as a result of which the errors which usually occur during a change of tools can be avoided.

In a first variant of the design, four spindles can be provided, namely, two tool spindles with the polishing tools and two combination spindles with combination tools, each of which comprises a workpiece holder and a dressing tool. In a second variant of the design, at least six spindles can be provided, namely, two tool spindles with the polishing tools, two workpiece spindles with the workpiece holders, and two dressing spindles with the dressing tools.

The task is accomplished by a device for polishing both sides of optical lenses with a first tool spindle, to which a first shaping tool is attached; a second tool spindle, to which a second shaping tool is attached; a first work piece spindle with a workpiece holder; and a second workpiece spindle with a second workpiece holder. The first shaping tool can be positioned in a working position relative to the first workpiece holder; the first workpiece holder can be brought into a transfer position relative to the second work piece holder, in which position the two workpiece holders are aligned with each other; and the second workpiece holder can be brought into a working position relative to the second shaping tool, the two shaping tools acting on different sides of the lens.

With this design, the goal is achieved that the first shaping tool can act on one side of the lens to polish it, whereas the second shaping tool can act on the other side of the lens to polish it. The change between the two processing steps is accomplished by transferring the lens from the first work piece holder to the second workpiece holder. Because the two workpiece holders are aligned with each other, the transfer can occur without rotating or turning the lens. The shaping tools can be positioned very accurately with respect to the workpiece holders, because no change of tools is required.

In the four-spindle version, a tool spindle and a combination spindle are mounted in the upper part of the polishing machine, and another pair of spindles are mounted in the lower part. The two combination spindles are in this case equipped with the previously mentioned combination tool, which has both a dressing tool and also a workpiece holder. In the case of the six-spindle version, a tool spindle, a workpiece spindle, and a dressing spindle are mounted in the upper part of the polishing machine, and another set of three is mounted in the lower part. In this case, work can be carried out without the combination tool; that is, the workpiece spindle is equipped with a workpiece holder, whereas a conventional dressing tool is attached to the dressing spindle.

The following text refers to the four-spindle version, but the basic meaning also applies to the six-spindle version.

In one of the embodiments of the device according to the invention, a so-called pivoting head, which can pivot around the B axis, is located in the upper part of the machine. The B axis is horizontal. The top combination spindle and the top tool spindle are both attached to this pivoting head. The axes of these two spindles are parallel to each other, and in the resting position they are vertical and are situated in a plane which is perpendicular to the B axis. By swinging the pivoting head around the B axis, the two spindles indicated above can be set jointly at an angle. The have a drive, by which they can be rotated.

A motorized combination spindle and a tool spindle are also provided in the lower part of the machine. The two axes of these spindles are parallel to each other, are vertical, and are situated in the same plane as that of the spindles above them. The two lower spindles are switched from right to left in comparison with the upper spindles; that is, seen in the vertical direction, a tool spindle is always paired with a combination spindle.

The two lower spindles are attached to a Z slide, which allows vertical movement, as a result of which the spindles can also be adjusted in this direction. The Z slide for its part is attached to an X slide, which allows horizontal movement perpendicular to the B axis. Thus it is possible to move the two lower spindles in both the X and Z directions.

In the six-spindle version, a third spindle, serving as a dressing spindle, is added to each of the other two sets of spindles at the top and bottom of the machine. The three spindles attached to the feed slides and the three spindles attached to the pivoting head can then be moved in the same way as described above for the four-spindle machine.

Other embodiments of the device according to the invention are also provided. For example, each of the two upper spindles (tool spindle and combination spindle) could also be attached to its own pivoting head, so that they can be pivoted independently of each other out of the vertical position. Accordingly, each of the two lower spindles (tool spindle and combination spindle) could also be attached to its own Z slide. Each of these two Z slides would then be attached to a separate X slide. In the arrangement described here, with a total of two pivot heads, two X slides, and two Z slides, it would be possible to polish two lenses simultaneously, which would lead to considerable savings with respect to both labor and investment.

The directional indications "X", "Z", and "B" are used for the sake of brevity. In the explanation provided here, it is to be assumed that the "X" direction is on a horizontal plane, and the "Z" direction is on a vertical plane, to which the "B" direction is perpendicular. It is possible to change the absolute directions in space while preserving the relationship of these directional indications among themselves.

In the method according to the invention and in the device for carrying out the method, it is also provided that the workpiece holder is composed of a hollow, cup-like cylinder, into the opening of which the lens is laid so that its edges rest on a small shoulder. So that the lens can be pressed against the polishing tool (shaping tool), the interior space of the workpiece holder is filled with polishing suspension, to which a selectable pressure can be applied. This hydrostatic support offers a whole series of advantages, which will be discussed in detail further below.

The polishing suspension, which is under pressure, presses the lens against the shaping tool. Thus the pressure required for polishing is produced. Polishing suspension also escapes through the very small gap between the lens and the workpiece holder and thus arrives, as desired, between the polishing surfaces of the shaping tool and the surface of the lens to be polished.

The sequence of events of the method according to the invention as implemented with an appropriate CNC device, including the various alternatives, is thus as follows:

First, the two shaping tools are dressed in succession, for which purpose the pivoting head is first swung out from its zero position. Then, after the two spindle drives have been started, either the combination tool (four-spindle version) or the dressing tool of the conventional design (six-spindle version) is moved in the direction of the X and Z axes until it is in contact with the shaping tool. The dressing process then proceeds, during which very fine feed motions are made in the Z direction.

Upon completion of the dressing process on both shaping tools, the spindles are moved apart again, and the first lens is placed in the workpiece holder of the first workpiece spindle. If dressing was performed with the combination tool, this combination tool is now changed over, either manually or automatically, so that now the workpiece holder, i.e., a plastic ring with the previously mentioned shoulder for supporting the lens, projects outwardly instead of the ring-shaped cutting edge carrying the abrasive material.

After the lens and the shaping tool have been adjusted in the X and Z directions to bring them into contact, polishing then proceeds with the pivoting head (with tool spindle and shaping tool) set at an angle. The polishing suspension which emerges through the ring-shaped gap between the workpiece holder and the lens distributes itself in ideal fashion between the polishing surfaces of the shaping tool and the surface of the lens.

The disadvantages encountered when working with a workpiece holder operated with air as described above are avoided by the hydrostatic support proposed here. Because the water-containing suspension is practically incompressible, the lens is pressed uniformly and consistently against the shaping tool. As a result of the good thermal conduction and high specific heat of water, furthermore, the lens is cooled very effectively on the front and back sides, and thus the above-cited undesirable heating of the lens is avoided. In addition, the suspension emerging continuously through the above-cited ring-shaped gap ensures that the lens remains wet even at the edges and that no dried-on residues can form in this area. The disadvantages which occur when working with a rubber membrane are also avoided. Because liquid presses directly against the back surface of the lens and no membrane is used, inaccuracies caused by imprecise membrane pressure cannot occur. The advantages cited here of the method according to the invention lead first to an increase in quality and to a decrease in cost in the polishing of lenses.

When the workpiece holder is discussed in the following, it always constitutes a part of the combination tool in question.

A very essential advantage of the method according to the invention and of the device for carrying out the method consists in that, after the first side of the lens has been polished, the lens can be transferred without manual intervention from the first workpiece holder to the second workpiece holder, where the second side is then polished. For this purpose, the pressure acting on the suspension in the first combination tool with the workpiece holder is first discontinued, and the tool spindle and combination spindle are then moved apart in the Z direction. Then the pivoting head is swung back into the zero position, and the X and Z slides are moved so that the first combination spindle is coaxial to the second, i.e., so that the axis of the first workpiece holder with the lens coincides with the axis of the second workpiece holder, and so that the two workpiece holders are nearly in contact with each other, i.e., are at the smallest possible distance from each other. By the action of the pressure being exerted on the polishing suspension in the first workpiece holder, the lens is pressed hydraulically out of the first holder and into the second workpiece holder.

The advantages are apparent; they are as follows:

It is especially advantageous that the lenses can be polished on both sides on a single machine. The investment costs are reduced correspondingly because there is no need for a second machine. The cost of labor is also significantly lower than that: incurred in the process according to the state of the art, because the lens is polished on both sides without manual intervention and also travels in the quickest possible way from the first to the second workpiece holder. It is to be emphasized in particular that the lens does not have to be turned around when being transferred from the first workpiece holder to the second, and no special devices are required for this transfer. The lens travels from the first to the second workpiece holder exclusively with the help of mechanical parts, devices, and control elements which would be required in any case for lens polishing and which would be present regardless of whether a transfer were made or not. The cost of the polishing machine according to the invention, which makes a second polishing machine superfluous and also saves the cost of intermediate storage and handling devices for changing the lenses, is also reduced correspondingly.

Because, after the first side has been polished, the lenses no longer need to be transferred manually from the workpiece holder of a first polishing machine to the workpiece holder of a second polishing machine for the polishing of the second side, and also because workpiece holders with rubber membranes are not used, another essential advantage consists in that there is no danger of damage to the first, finished side of the lens. For this reason, there is no longer any need to apply the previously mentioned layer of protective lacquer. The cost of labor and the investment for the work step of applying the protective lacquer are thus eliminated. The same also applies, of course, to the work step of removing the protective lacquer.

Additional details of the method according to the invention and of the device for carrying out the method will be explained on the basis of FIGS. 1–3. It is assumed that all machine functions are numerically controlled by computer. Only the basic principle is illustrated in the Figures on the basis of four machine spindles and their positions relative to each other. As provided in the case of the four-spindle machine, two combination tools are shown in the Figures (dressing tool with integrated workpiece holder). In the illustrated embodiment, the two upper spindles are attached to a pivoting head, which can be swung about the B axis, whereas the two lower spindles are connected to a feed system, which allows movement in the X and Z directions. The various drive systems and other details are not shown.

In principle, however, other arrangements are also possible. It is provided also in particular that the four spindles can be moved independently of each other, so that two lens sides can be polished simultaneously, in which case combination tools are again used.

The six-spindle polishing machine corresponds in the way it works and in its construction to the four-spindle machine shown here. In the embodiment as a six-spindle machine, each of the dressing tool spindles would be attached to the spindle for the workpiece holder on a common feed system.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
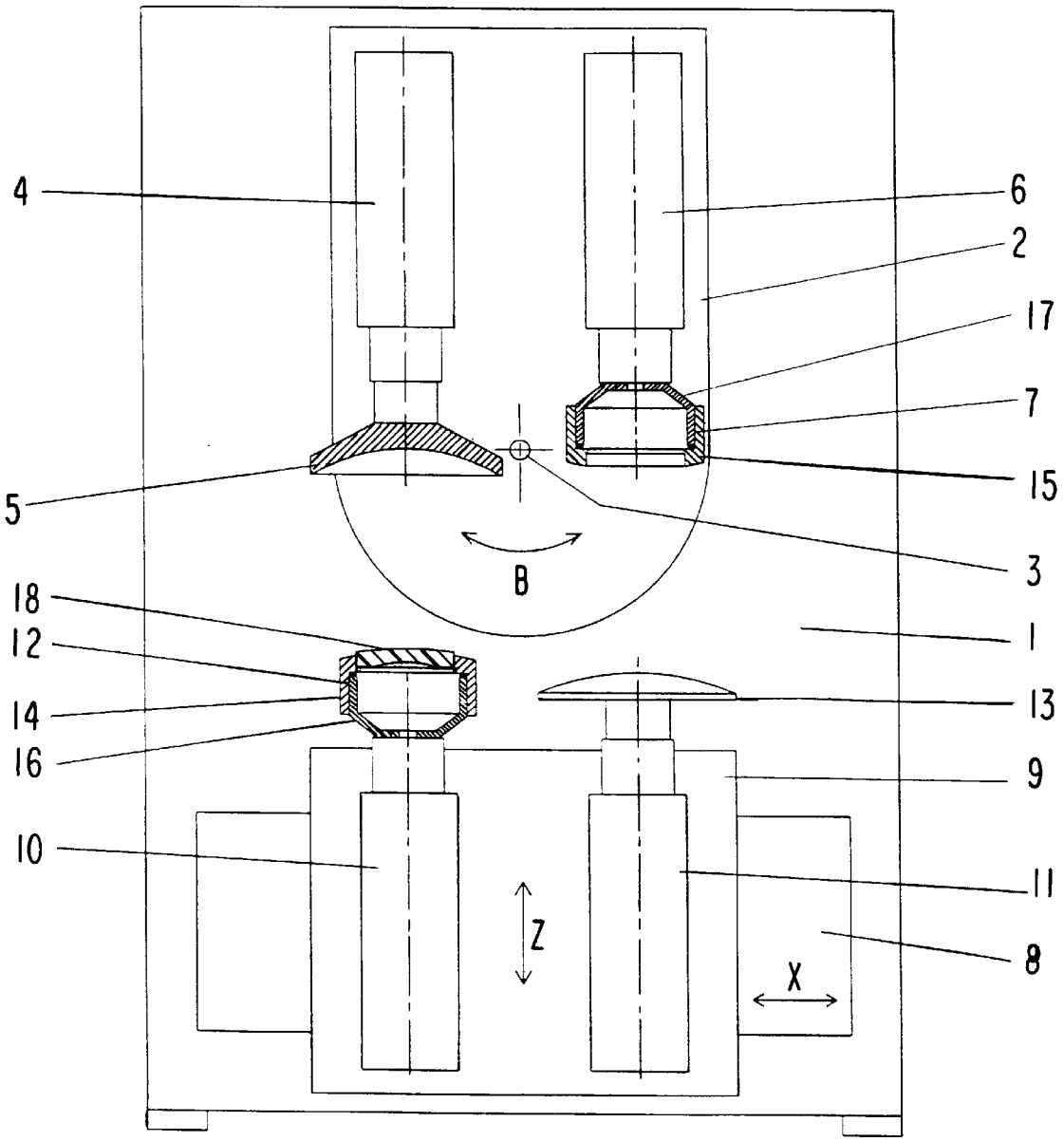
FIG. 1 shows an overall view of the machine in highly schematic fashion.

In FIG. 1, a pivoting head 2, which can pivot around the B axis 3, is supported in the upper area of a machine frame 1. A tool spindle I 4 is attached to the pivoting head 2; the lower end of this spindle carries a shaping tool I 5 for a convex lens surface. Also connected to the pivoting head 2 is a combination spindle II 6, to the lower end of which a combination tool II 7 is attached.

In the lower area of the machine frame 1, an X slide 8 is supported in such a way that it can execute horizontal movements perpendicular to the B axis 3. A Z slide 9, which makes vertical movements possible and which carries a combination spindle I 10 and a tool spindle II 11, is connected to the X slide 8. The combination tool I 12 is attached to the upper end of the combination spindle I 10, whereas the shaping tool II 13 is attached to the upper end of the tool spindle II 11. The combination tool I 12 includes an inner part, i.e., a dressing tool I 16, which is connected to the combination spindle I 10, and an outer part, i.e., the work piece holder I 14. The combination tool II 7 also includes an inner dressing tool II 17, which is connected to the combination spindle II 6, and an outer workpiece holder II 15.

Figure 2:
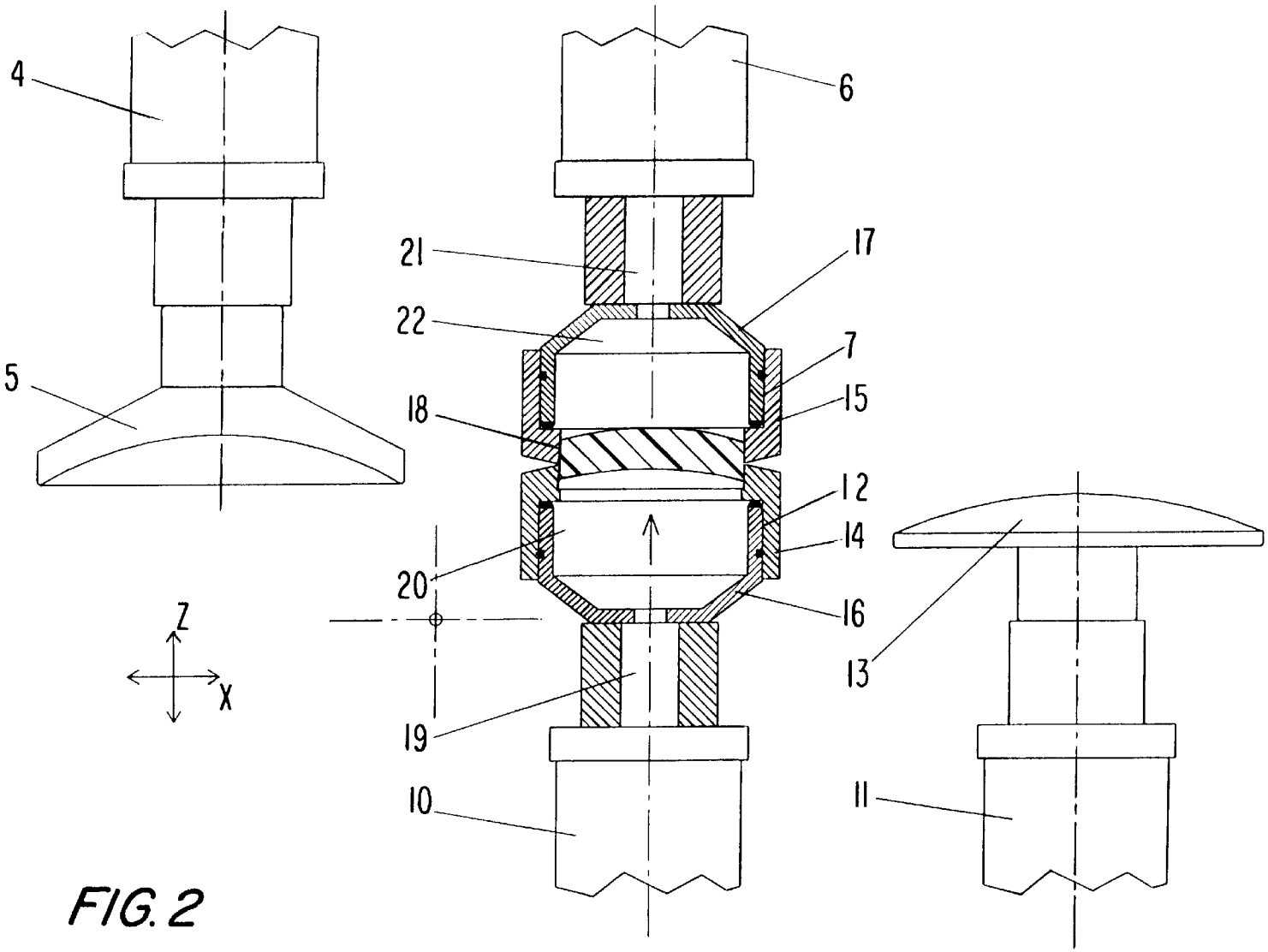
FIG. 2 shows the transfer of the lens from the lower workpiece holder to the upper workpiece holder.

FIG. 2 shows how the lens 18 to be processed is transported from the combination tool I 12 to the combination tool II 7. For this purpose, the combination spindle I 10 is first moved along the X axis until it is vertically precisely underneath the combination spindle II 6; then, by the movement of the combination spindle I 10 along the Z axis, the workpiece holder I 14 and the workpiece holder II 15 are brought together until they almost touch. The dressing tool I 16 and the dressing tool II 17 are connected to the combination spindle I 10 and to the combination spindle II 6, respectively, and carry the workpiece holder I 14 and the workpiece holder II 15 assigned to them.

The lens 18 is first located in the workpiece holder I 14 of the combination tool I 12. The pressure exerted by the polishing suspension filling the interior cavity 19 of the combination spindle I 10 and the interior space 20 of the combination tool I 12 then forces the lens hydraulically into workpiece holder II 15 of the combination tool II 7. During this process, the interior cavity 21 of the combination spindle II 6 and thus also the interior space 22 of the combination tool II 7 are relieved of pressure.

The lens 18 is thus now located in the position in which its second side can be polished.

An essential advantage of the method according to the invention and of the device for carrying out the method consists in that the polishing suspension which emerges during the process of transferring the lens 18 does no harm, because the polishing process proceeds in any case with copious amounts of polishing suspension. The use of the same medium to transport the lens 18 from the workpiece holder I 14 to the workpiece holder II 15, to press the lens 18 against the shaping tool I 5 or the shaping tool II 13, and to accomplish the actual polishing process is therefore an essential component of the present invention.

Figures 1, 2, 3, 4, 5, 6, 7, 8:
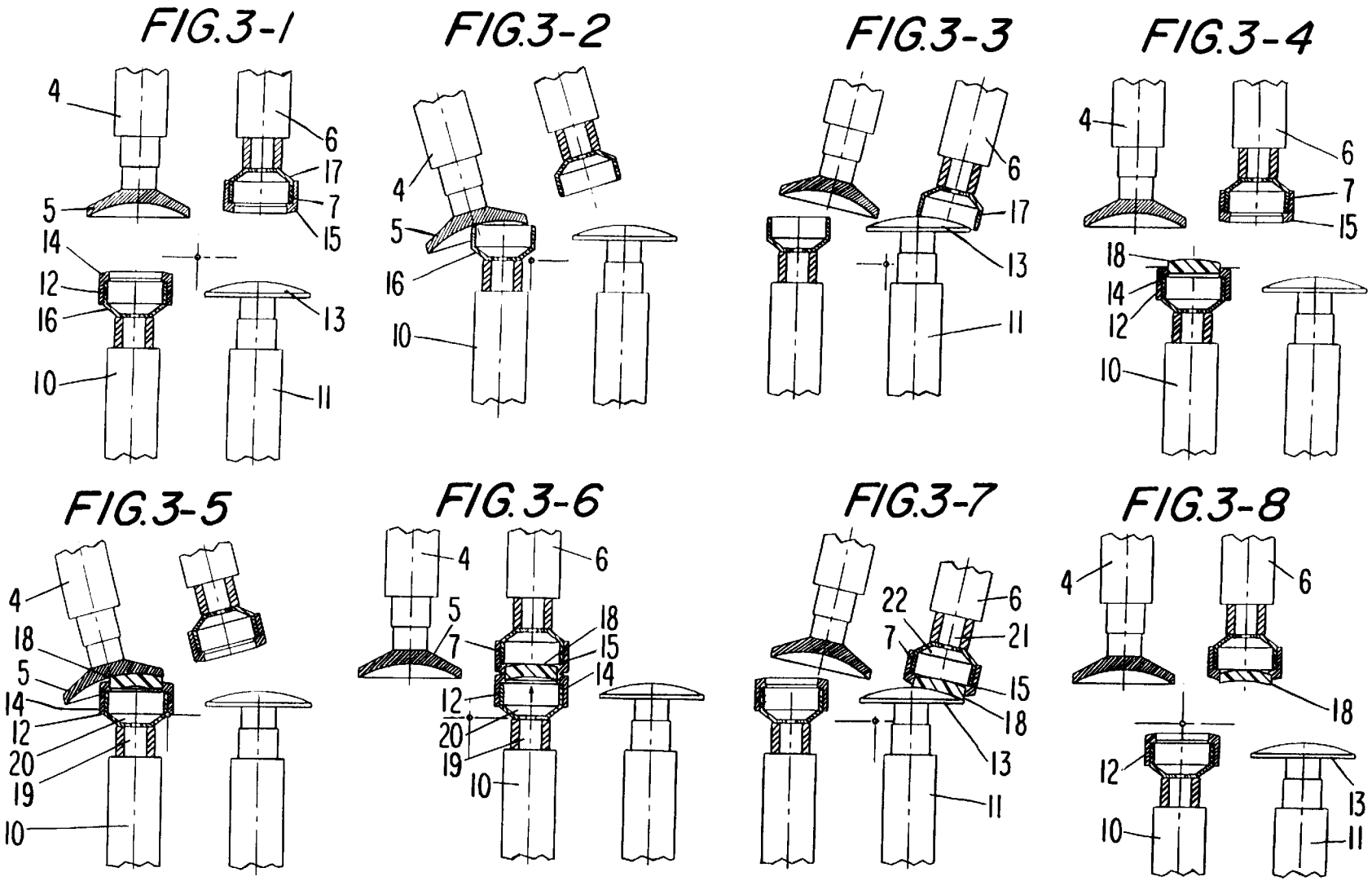
FIG. 3 shows the essential processing steps as a sequence of 8 stages.

FIG. 3 shows the polishing of a lens 18, including the dressing of the shaping tool I 5 and the shaping tool II 13, in 8 separate stages. For the sake of clarity, the Figure shows only the four spindles with the tools attached to them and the lens 18. In particular, the pivoting head 2 is not shown. While the shaping tools 5, 13 are being dressed and also while the lens 18 is being polished, the axes of the participating spindles are set at an angle to each other. The two axes must intersect at the center of curvature of the lens 18 or of the shaping tool 5 or 13.

Because, for space reasons, the illustrations are drawn to fit their frames (same distance to the boundary line on both the right and left sides), the shift in the positions of the spindles between one stage and the next is shown as their relative distance to the intersecting of the coordinates.

Stage 1=Basic Position

Here the basic position of the four spindles of the polishing machine is shown.

Stage 2=Dressing of Shaping Tool I 5

The workpiece holder I 14 has been removed from the combination tool I 12 (either manually or automatically) to expose the dressing tool I 16. The pivoting head 2 has been set at an angle, which means that the tool spindle I 4 with the shaping tool I 5 is also at an angle. By adjustment in the X and Z directions, the dressing tool I 16 is brought into contact with the shaping tool I 5, after the drives of the combination spindle I 10 and of the tool spindle I 4 were previously started turning in opposite directions. By advancing the dressing tool I 16 in the Z direction, the desired amount of material is removed in the precision range.

Stage 3=Dressing of Shaping Tool II 13

The workpiece holder II 15 has been removed from the combination tool II 7 (either manually or automatically) to expose the dressing tool II 17. The pivoting head 2 has been set at an angle in the other direction, which means that the combination spindle II 6 is also at an angle. By adjustment in X and Z directions, the shaping tool II 13 is brought into contact with the dressing tool II 17, after the drives for the combination spindle II 6 and the tool spindle II 11 have previously been started turning in opposite directions. By advancing the shaping tool II 13 in the Z direction, the desired removal of material is removed in the precision range.

Stage 4=Insertion of Lens 18 into Workpiece Holder I 14

The workpiece holder I 14 has been reattached (manually or automatically) to the combination tool I 12, and the workpiece holder II 15 has been reattached (manually or automatically) to the combination tool II 7. To facilitate these operations, the pivoting head 2 has been swung back into its zero position, so that the axes of the tool spindle I 4 and of the combination spindle II 6 are vertical. By adjustment in the X and Z directions, the combination spindle I 10 with the workpiece holder I 14 is brought into a position which allows the insertion of the lens 18 (manually or automatically).

Stage 5=Polishing of the First, Convex Side of Lens 18

The pivoting head 2 is set at an angle, which means that the tool spindle I 4 with the shaping tool I 5 is also at an angle. By adjustment in the X and Z directions, the lens 18 in the workpiece holder I 14 of the combination spindle I 10 is brought into pressureless contact with the shaping tool I 5, after the drives for the tool spindle I 4 and the combination spindle I 10 have previously been started. Then polishing suspension is conducted via the internal cavity 19 in the combination spindle I 10 to the interior space 20 of the combination tool I 12 and put under pressure. Thus the lens 18 is pressed against the shaping tool I 5, and the polishing suspension emerging from the ring-shaped gap between the lens 18 and the workpiece holder I 14 ensures the desired removal of material during polishing. It is not necessary to advance the machine spindle, because the lens 18 is continuously pressed by the polishing suspension in the direction of the shaping tool I 5.

Stage 6=Transport of Lens 18 from Workpiece Holder I 14 to Workpiece Holder II 15

The pivoting head 2 is moved back into a vertical position, which means that the tool spindle I 4 with the shaping tool I 5 and the combination spindle II 6 with the combination tool II 7 are also now vertical. The X slide and the Z slide are moved in such a way that the combination spindle I 10 is now aligned coaxially with the combination spindle II 6; that is, the axis of the workpiece holder I 14 coincides with the axis of the workpiece holder II 15, and the two workpiece holders 14, 15 are almost touching, that is, are at the shortest possible distance from each other. By the action of the pressure exerted on the interior cavity 19 of the combination spindle I 10 and thus also on the interior space 20 of the combination tool I 12, the lens 18 is forced hydraulically out of the workpiece holder I 14 and into the workpiece holder II 15.

Stage 7=Polishing of the Second, Concave Side of Lens 18

The pivoting head 2 is set at an angle, which means that the combination spindle II 6 with the combination tool II 7 and the workpiece holder II 15, which carries the lens 18, are also at an angle. By adjustment in the X and Z directions, the shaping tool II 13 is brought into pressureless contact with the lens 18, after the drives for the tool spindle II 11 and the combination spindle II 6 have been started. Then polishing suspension is conducted via the inner cavity 21 of the combination spindle II 6 to the interior space 22 of the dressing tool II 17 and put under pressure. Thus the lens 18 is pressed against the shaping tool II 13, and the polishing suspension emerging from the ring-shaped gap between the lens 18 and the workpiece holder II 15 ensures the desired abrasive action during polishing.

Stage 8=Removal of the Finished, Polished Lens 18

To make handling easier, the pivoting head 2 is swung back into its zero position, so that the axes of the tool spindle I 4 and the combination spindle II 6 are vertical. By moving the combination spindle I 10 and the tool spindle II 11 in the X and z directions, they are brought into a position in which the combination tool I 12 and the shaping tool II 13 do not interfere with the removal (by hand or automatic) of the lens 18. It is also provided that, before the lens 18 is removed, it is transported from the workpiece holder II 15 back to the workpiece holder I 14, so that the lens 18 can be removed from the workpiece holder which is in the lower position, i.e., the workpiece holder I 14. This embodiment has not been illustrated.

While specific embodiments of the invention have been shown and described in detail to illustrate the inventive principles, it will be understood that the invention may be embodied otherwise without departing from such principles.

I claim:

1. A method of polishing first and second sides of an optical lens, the method comprising placing the lens in a first workpiece holder and polishing the first side of the lens, positioning a second workpiece holder opposite the first workpiece holder, transferring the lens without turning the lens to the second workpiece holder, and polishing the second side of the lens from a side of the first workpiece holder.

2. The method according to claim 1, comprising pressing the lens in the first and second workpiece holders against a shaping tool using a pressurized polishing suspension.

3. The method according to claim 2, comprising pressing the lens out of the first workpiece holder using the pressurized polishing suspension and pressing the lens into the second workpiece holder using the pressurized polishing suspension.

4. The method according to claim 2, comprising using shaping tools for polishing and dressing the shaping tools used for polishing by using dressing tools, wherein means for positioning the dressing tools relative to the shaping tools are also means for positioning the shaping tools relative to the workpiece holders.

5. The method according to claim 4, comprising using one of the workpiece holders as a support means for one of the dressing tools.

6. The method according to claim 2, comprising jointly moving one of the workpiece holders and one of the shaping tools arranged on one side of the lens and jointly moving another workpiece holder and another shaping tool arranged on another side of the lens.

7. The method according to claim 2, comprising moving both workpiece holders and the shaping tools independently of each other.

* * * * *